US007226373B2

(12) United States Patent
Arenas

(10) Patent No.: US 7,226,373 B2
(45) Date of Patent: Jun. 5, 2007

(54) BATTING SWING PRACTICE APPARATUS

(75) Inventor: Pedro Arenas, Bishop, GA (US)

(73) Assignee: Horton Sports, LLC, Eatonton, GA (US)

( * ) Notice: Subject to any disclaimer, the term of this patent is extended or adjusted under 35 U.S.C. 154(b) by 0 days.

(21) Appl. No.: 11/224,469

(22) Filed: Sep. 12, 2005

(65) Prior Publication Data

US 2007/0060418 A1 Mar. 15, 2007

(51) Int. Cl.
*A63B 69/00* (2006.01)

(52) U.S. Cl. ..... 473/417; 473/422

(58) Field of Classification Search ..... 473/422–431, 473/454, 462, 476–479; 273/407, 348; 248/121, 248/122.1, 125.7, 126, 125.8, 127, 125.9, 248/157, 425.7

See application file for complete search history.

(56) References Cited

U.S. PATENT DOCUMENTS

| | | | | |
|---|---|---|---|---|
| 1,962,087 | A | 6/1934 | Cone | |
| 2,818,255 | A | 12/1957 | Ponza | |
| 3,908,990 | A | 9/1975 | Spurgeon | |
| 4,175,744 | A * | 11/1979 | Llewellyn | 473/149 |
| 4,508,339 | A | 4/1985 | Llewellyn | |
| 4,555,110 | A | 11/1985 | Hai-Ping | |
| 4,699,377 | A | 10/1987 | Ponza | |
| 5,467,978 | A | 11/1995 | Paluch | |
| 5,472,186 | A | 12/1995 | Paulsen | |
| 5,531,438 | A | 7/1996 | Corley | |
| 5,553,848 | A | 9/1996 | Amron | |
| 5,601,286 | A | 2/1997 | Fierbaugh | |
| 5,611,539 | A * | 3/1997 | Watterson et al. | 473/197 |
| 5,618,039 | A | 4/1997 | Tsai et al. | |
| 5,788,589 | A | 8/1998 | Koo et al. | |
| 5,873,798 | A * | 2/1999 | Bostick | 473/426 |
| 5,989,137 | A | 11/1999 | Krueger | |
| 6,099,419 | A | 8/2000 | Incaudo et al. | |
| 6,296,582 | B1 | 10/2001 | Minniear | |
| 6,390,939 | B1 * | 5/2002 | Palacios | 473/422 |
| 6,458,037 | B1 | 10/2002 | Dixon, Jr. | |
| 6,688,994 | B2 | 2/2004 | Matulek et al. | |

OTHER PUBLICATIONS

Stroke Coach Brochure, 2000, Horton Sports.

* cited by examiner

*Primary Examiner*—Mitra Aryanpour
(74) *Attorney, Agent, or Firm*—Jason A. Bernstein; Powell Goldstein LLP

(57) ABSTRACT

A batting practice apparatus comprising an upright support mast associated with a base having a plurality of legs which are able to be mounted to a surface. A rotatable sleeve slides over the mast. The sleeve can rotate about the mast and a pin slides within the slots. An arm with a ball-shaped object at the distal end extends from the sleeve. An elastic member is associated at one end with the sleeve by means of a tab extending from the sleeve; and, at the other end is associated with a base leg. When the batter strikes the ball-shaped object, the sleeve rotates upward about the mast and returns as urged by the elastic member.

11 Claims, 3 Drawing Sheets

BATTING SWING PRACTICE APPARATUS

FIELD OF THE INVENTION

The present invention relates to the field of baseball practice and training aids. More particularly, the present invention relates to a batting swing practice apparatus that enables a batter to repeatedly strike a baseball target without having to manually reset an apparatus or recover a struck ball.

BACKGROUND OF THE INVENTION

Batting training aids, devices and apparatus have been known for decades. The goal of many of them is to provide a realistic sensation of hitting a baseball and seeing the results of the hit for swing analysis, yet returning the ball to the same pre-strike position without the batter having to manually reset the ball or apparatus, i.e., without having to chase and retrieve a hit ball.

BACKGROUND OF THE ART

U.S. Pat. No. 6,458,037, issued to Dixon, Jr. discloses a batting training apparatus having a base, a telescoping two-segment support mast, and a horizontal arm with an extended arm with a ball-shaped object associated therewith at the distal end. The horizontal arm proximal end has a hook which holds one end of an elastic cord; the other end of the cord is attached to one of several hooks on the base leg. A disadvantage of this apparatus is the lack of defined stop point of rotation of the horizontal arm after the ball is struck, other than the extent of elasticity of the elastic cord.

U.S. Pat. No. 2,818,255, issued to Ponza, discloses a batting practice device in which a post mounted in the ground has a collar that rotates when a bat strikes a ball mounted on the end of an arm associated with the collar. The collar has a cam surface which rotates over a pin. A spring is mounted inside the post with the lower end fixed to a pin and the upper end mounted to a connecting rod which is associate with the cam collar. When the ball is struck the collar rotates and rises, thereby stretching the spring. The spring's elasticity urges the collar to counter-rotate back to its original position. This apparatus requires an internal spring, with the problem of the mast having to be disassembled in the event the spring must be changed. Additionally, there is no convenient and quick way to adjust the tension on the spring for different batters.

U.S. Pat. No. 4,508,339, issued to Llewellyn, discloses an eye-hand coordinator, which uses a spring mounted around the support mast and over the arm to dissipate the energy imparted to the arm when the ball is struck and the arm rises on a cam surface. Llewellyn cannot conveniently change the spring to accommodate different strength hitters' swings.

It would be desirable to have a mountable practice device that can vertically adjust the height of the ball to be struck as well as the absorbability of the energy of the swing. Further, it would be desirable to have a device which can easily be fully or partially disassembled for transport and storage without requiring separate tools. Additionally, such an apparatus should be able to accommodate left- as well as right-hand hitters.

SUMMARY OF THE INVENTION

The present invention provides, in one exemplary embodiment, a batting practice apparatus comprising an upright support mast associated with a base having a plurality of legs which are able to be attached to a surface, such as the ground. A rotatable sleeve is slid over the mast. The sleeve has upper and lower halves, each half having a pair of opposing slots formed therein, each slot in the upper half curving clockwise downward, each slot in the lower half curving counterclockwise downward. A pin is inserted through a pair of slots in the lower half and through one of several apertures in the mast. The sleeve can rotate about the mast and the pin slides within the slots. An arm with a ball-shaped object at the distal end extends horizontally from the sleeve. An elastic member is associated at one end with the sleeve by means of a tab extending from preferably about the midpoint of the sleeve; and, at the other end is associated with a base leg. When the batter strikes the ball-shaped object the sleeve rotates upward about the mast until about the end of the slot is reached and the elastic member has elongated to a general limit. The elastic member urges the sleeve to counter-rotate to return to its original position to enable the batter to swing again without having to move from the original batting position.

Other features of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DESCRIPTION OF THE INVENTION

Figure 1:
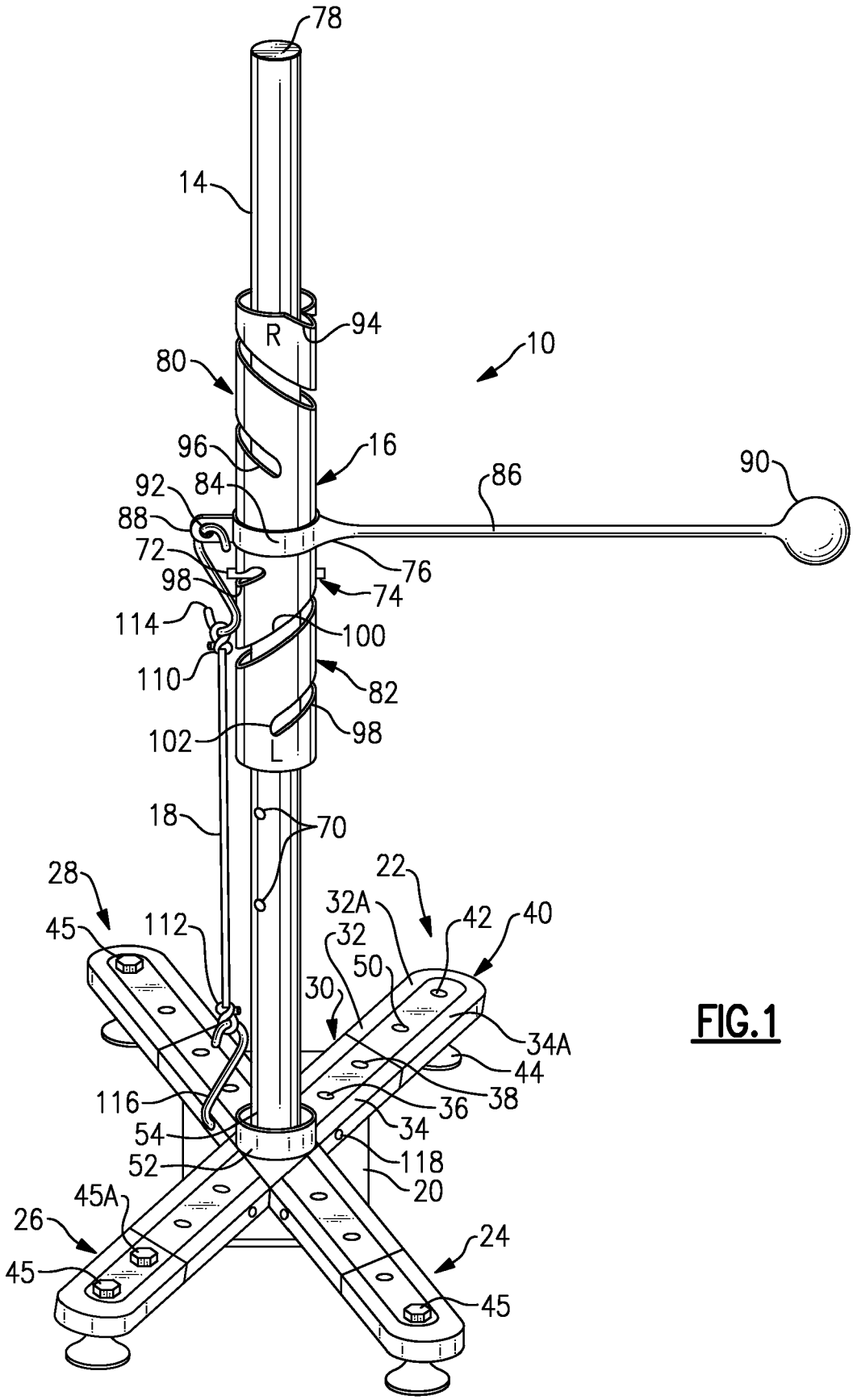
FIG. 1 is a perspective view of one exemplary embodiment of the present invention.

FIG. 1 shows one exemplary embodiment of a batting swing practice apparatus of the present invention in which an apparatus 10 has main components comprising a base 12, support mast 14, rotatable sleeve 16 and elastic member 18.

The base 12, mast 14 and sleeve 16 are preferably made of a generally rigid sturdy material, such as, but not limited to, plastic, metal, polymer, alloy, and mixtures or combinations of the foregoing. In one preferred embodiment the material is plastic.

The base 12 comprises a plate 20 having a set of legs 22, 24, 26 and 28 extending from the plate at generally right angles to one another. It is possible to modify this basic configuration to have two or three legs or more than four legs, as desired, with appropriate angling from each other. Alternatively, the plate 20 may also be a generally circular plate. However, a four leg configuration may be optimal for support, stability and material usage. The legs are preferably substantially the same, so the following description applies to each leg. The leg 22 may comprise a single length of material. Preferably, the leg comprises a first leg segment 30 and may have ribs 32, 34 for additional strength and support. The first leg segment 30 has at least one, and preferably, two apertures 36, 38. A second leg segment 40 has ribs 32A, 34A, which mate with ribs 32, 34 with the first and second segments being joined together, such as by a nut and bolt, screw, or other fastening device. The second leg segment 40 preferably has an aperture 42.

Figure 3:
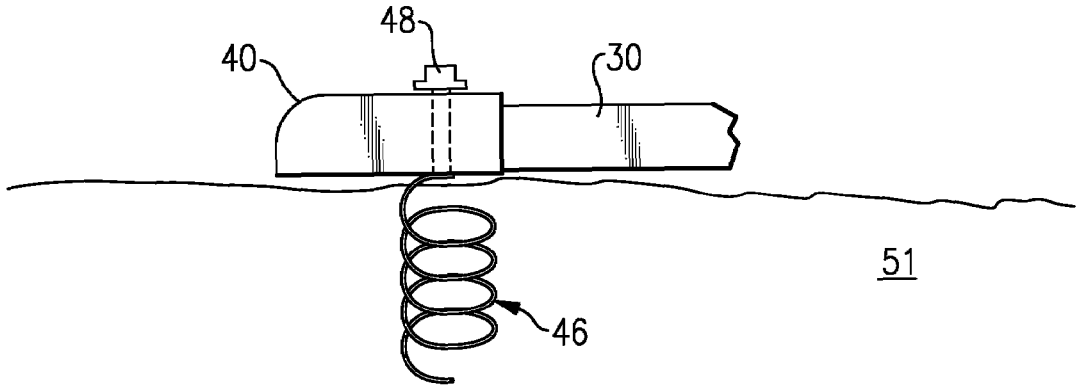
FIG. 3 is a side view of a detail of the leg.
Figure 4:
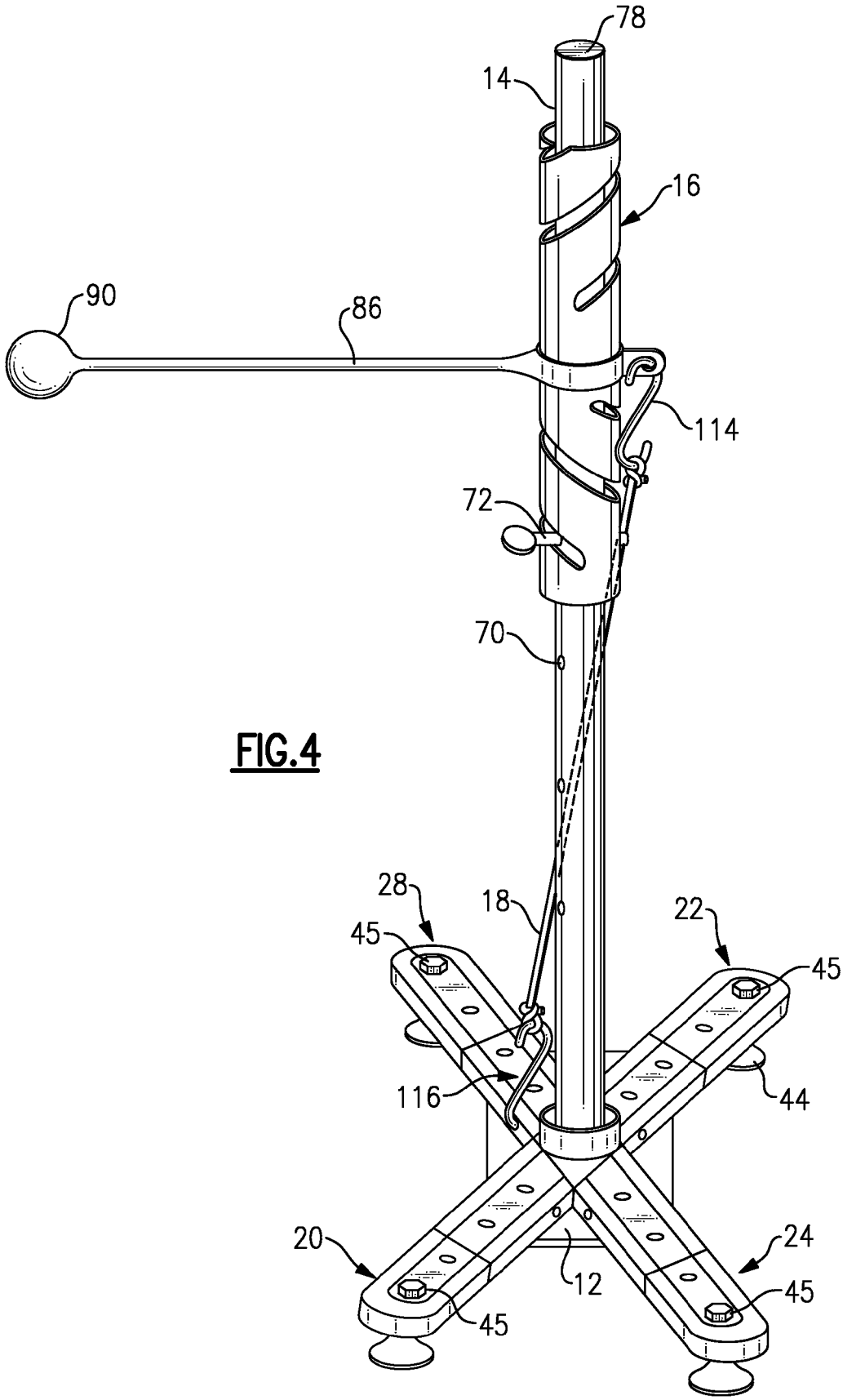
FIG. 4 is a perspective view of the embodiment of FIG. 1 when the sleeve is rotated about the support mast.

The leg 22 may be attached to a surface, such as a flat floor (e.g., wood, tile, linoleum, or the like) preferably by means of a set of suction cups 44 which are mounted to the second leg segment (for each leg) 40 by means of a bolt 45 passing through aperture 42 and screwed into the suction cup 44. The suction cup 44 is best suited for surfaces which can accommodate a suction cup mechanism of attachment. Optionally, a second suction cup 44 (not shown in FIG. 1) can be attached to the leg 22 via a bolt 45A passing through the aperture 38. For ground, such as earth, the second leg segment 40 may be attached by means of a large helical screw 46, having a handle portion 48. The screw 46 is passed through an aperture 50 and into the soft ground 51, as shown in FIG. 3. It is contemplated that other attachment means can be used, such as, but not limited to, adhesive, bolts, screws, clamps, or the like.

Figure 2:
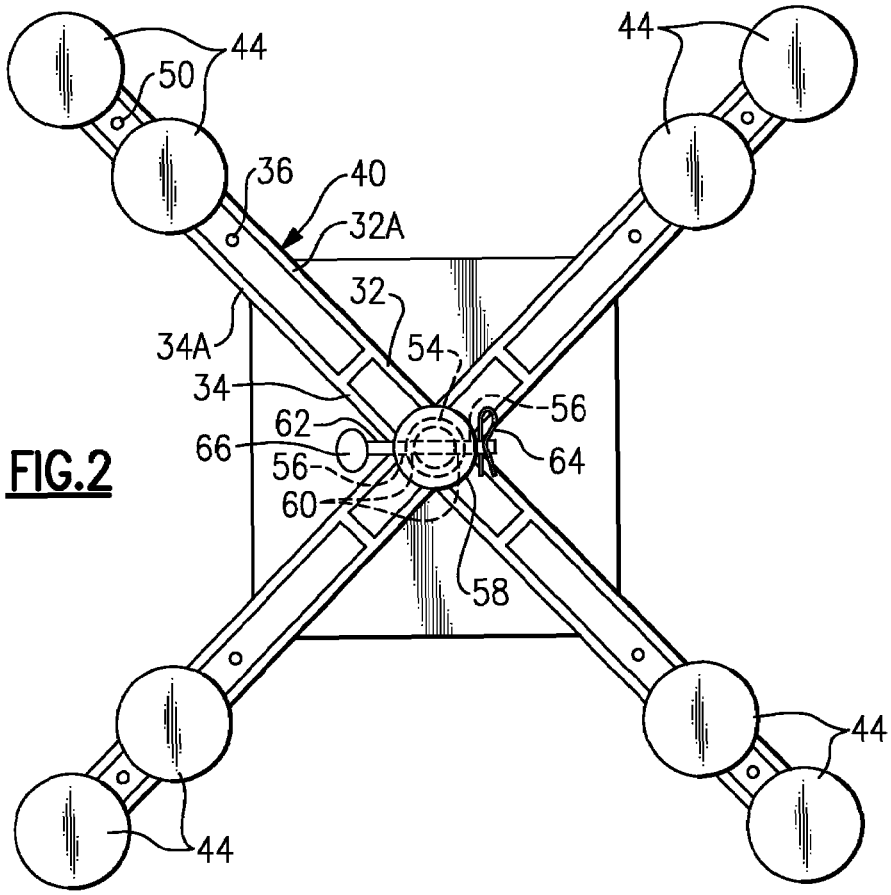
FIG. 2 is a bottom plan view.

While it is possible for the support mast 14 and base 12 to be constructed of a single piece of material, it will likely be more cost effective from a manufacturing, assembly and shipping standpoint to have two pieces which are separate and assemblable. The support mast 14 is mounted to the base 12 as follows. The base 12 has a base collar 52 into which the support mast 14 can be inserted. The bottom portion 54 of support mast 14 also has an aperture 56 (not shown) passing through thereof. At the underside of the base 12, shown in FIG. 2, the base 12 has the lower portion 58 of the base collar 52. The base collar lower portion 58 has an aperture 60 passing therethrough. When the support mast bottom portion 54 is inserted into the base collar 52, the support mast bottom aperture 56 is aligned with the base collar lower portion aperture 60 and a pin 62 is inserted through both apertures 56, 60 and secured by a cotter pin 64 or other retention device. The pin 62 may optionally have a ring 66, knob, handle or other grasping mechanism attached thereto to enable a user to remove the pin 62. In this manner the support mast 14 can be removably and securely fastened to the base 12. It is to be understood that other attachment mechanisms can be used to fastened the base 12 to the support mast 14, such as, but not limited to, clips, mating threaded screws, bolts, snaps and the like. It is preferable to have an attachment mechanism that is easily manipulated to enable a user to quickly assemble and disassemble the support mast and base for use or transport.

The support mast 14 preferably has a number of apertures 70 passing through the generally middle portion of the mast. A mast pin 72 can be inserted into any of the apertures 70 and held in place by a pin 74 such as a cotter pin and a washer 76, or other commonly used means for removably securing the pin 72 in place. The support mast 14 optionally may have a removable cap 78 to keep dirt and debris from entering the support mast. The cap 78 may also function to keep the sleeve 16 on the support mast 14.

The sleeve 16 generally comprises a first segment 80, second segment 82, middle segment 84, arm 86 and tab 88. When the sleeve 16 is positioned on the support mast 14 as shown in FIG. 1, the first segment 80 (with accompanying marking "R" for right-hand batting practice) is above the second segment 82 (with accompanying marking "L" for left-hand batting practice). The arm 86 extends generally horizontally outward and, at its distal end, has an object 90 associated therewith preferably of generally the same size and feel (i.e., weight and hardness) of a soft or hard baseball. In one exemplary embodiment Fiberglas or other rigid material formed as a rod is inserted and centered into a ball mold. A foam material which creates the ball is injected into the mold and adhered to the rod. The tab 88 has an aperture 92 or notch or slot or other receiving means.

The first segment 80 has at least one and preferably two slots 94, 96 curved downward around the first segment 80 in a clockwise direction when viewed from top down. The second segment 82 has at least one and preferably two slots 98, 100 curved downward in a counter clockwise direction when viewed from top down around the second segment 82. The slots can accommodate the mast pin 72. The two slots 94, 96 and 98, 100 are preferably arranged on opposite sides of the sleeve 16 so that the pin 72 can pass through both slots.

For right-hand batting practice, the sleeve 16 is slid over the support mast 14 with the first segment 80 being above the second segment 82. The second segment 82 slot 98 is aligned with an aperture 70 and the mast pin 72 is inserted through the slots 98, 100 and aperture 70 and the mast pin 72 is held securely in place using a cotter pin 74 and preferably a washer 76. The sleeve 16 can rotate about the support mast 14 and, in doing so, the slots 98, 100 rotates about the sleeve 16 with the pin 72 guiding and limiting the movement. As the sleeve 16 rotates, the sleeve 16 is raised vertically along the axis of the support mast 16. When the terminal end 102 of the slots 98, 100 is reached the sleeve 16 stops rotating.

The apparatus 10 also incorporates an elastic biasing mechanism comprising an elastic member 18, which preferably is made of rubber or other elastic material. Alternatively, the elastic member may be a coiled spring, bungee cord, elastic fibers, spandex, or other material having suitable elastic qualities. In a preferred embodiment the apparatus 10 is supplied with several elastic members 18, each preferably having a different modulus of elasticity such that each member 18 has a different resistance. Alternatively, the apparatus 10 can be supplied with several elastic members 18 and two or more can be used simultaneously to increase resistance. The elastic member has a first end 110 and a second end 112, each end preferably having a first and second hook 114, 116 or other attachment mechanism associated therewith. The first hook 114 can be attached to the tab 88, such as through the aperture 92 or notch. The second hook 116 can be attached to the leg 28 (or any other leg as shown in FIG. 1) through an aperture 118.

In operation, the sleeve 16 is set at the appropriate initial height based upon the height or swing style of the batter by raising or lowering the sleeve 16 and positioning the slots 98, 100 in alignment with the appropriate mast aperture 70 and inserting the pin 72 to set the sleeve 16 in position. For a right-hand batter, the apparatus 10 is set up and the batter can strike the object 90 with the bat using a conventional batting swing. As the object 90 is struck, the arm 86 imparts rotational energy to the sleeve 16, which rotates about the support mast 14 and the pin 72 moves within the slot 98 so that the sleeve 16 rises as it rotates. The elastic member 18 elongates since one end 116 is attached to the base via the aperture 118 and the other end 110 to the tab 88 on the sleeve 16. As the elastic member 18 elongates it twists around the support mast 14. The maximum extension occurs when the slot terminal end 102 abuts the pin 72. The elastic member 18 seeks to retract to its original length and urges the sleeve 16 to counter-rotate to its original position, thereby placing the object 90 in essentially the same position in which it started, thus enabling the user to again strike the object 90 without having to reset anything or to move from the proper position. The base 12 remains in position during the striking and reset activity either by being attached to the earth by means of the screw 46 or a smooth surface by the suction cups 44. The sleeve 16 can be removed for transport and storage by removing the cotter pin 74 and the mast pin 72.

The support mast 14 can be removed from the base 12 by removing the base cotter pin 64 and the pin 62.

The apparatus 10 is designed for left- or right-hand hitters by simple removing the sleeve 16 and inverting it. The reversed direction slots 96, 98 allow a left-hand hitter to use the apparatus 10 equally as well as a right-hand hitter.

The different elastic members 18 can be used to create different resistance levels. For younger or easier swinging hitters, elastic member 18 can be chosen as the one with the least resistance. Older stronger hitters will likely want to use a more resistive elastic member 18 so that the stronger striking force energy will be absorbed by the more resistive elastic member 18.

An advantage of the present invention is that it can be used in connection with most indoor or outdoor surfaces or environments where a suction cup or ground screw can be used. The present invention can be assembled and mounted quickly and easily, essentially without any tools required. Additionally, the apparatus can be partially or fully disassembled for transport or storage, i.e., the arm and/or base can be easily separated from the support mast using the pin. The use of the unique sleeve and elastic member enables a user to maintain proper batting position for repetitive swing practice by returning the ball object to the same position after every swing.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

It should further be noted that any patents, applications and publications referred to herein are incorporated by reference in their entirety.

The invention claimed is:

1. An apparatus for batting practice, comprising:

a) an upright support member having an upper end and a lower end and at least one hole defined in said support member;

b) a pin capable of being inserted in one of said at least one hole, said pin having a retention means for retaining said pin in said hole;

c) a generally horizontal base having i) a plurality of legs extending horizontally therefrom, ii) leg fastening means for removably securing each of said plurality of legs in a fixed position, iii) said base being mountable to said support member;

iv) at least one fastening means defined in said base;

d) a ball suspension rod having i) a distal end having a substantially ball-shaped object associated therewith, ii) a proximal end, iii) a sleeve associated with said proximal end, said sleeve being capable of fitting over said support member and comprising (1) an upper portion having a pair of opposing helical shaped grooves defined therein, said grooves spiraling downward counterclockwise, each of said upper portion grooves being capable of receiving said pin, (2) a lower portion having a pair of helical shaped grooves defined therein, said grooves spiraling downward clockwise, each of said lower portion grooves being capable of receiving said pin, (3) a middle portion having a tab extending therefrom, said tab having an opening; and, e) at least one elastic member having i) a first end having a first fastening means associated therewith for fastening to said tab and ii) a second end having a second fastening means associated therewith for fastening to said at least one fastening means in said base, whereby said sleeve is biased by said at least one elastic member in a resting "home" position and when said ball-shaped object is struck said sleeve rotates at least partially around said support member.

2. The apparatus of claim 1, further comprising a securing means associated with each said leg for removably securing said leg to a generally flat surface, such as earth or a floor.

3. The apparatus of 2, wherein said leg securing means comprises a suction cup associated with said leg.

4. The apparatus of 2, wherein said leg securing means comprises a screw capable of being screwed into soft ground.

5. The apparatus of claim 1, said support member having a second aperture defined in said lower end, said base having a sleeve defined therein sized to receive said support member, said sleeve further including an aperture, whereby said second aperture and said sleeve aperture are alignable and can receive a second pin for securing said support member to said base.

6. The apparatus of claim 1, wherein said support member is removably attached to said base.

7. The apparatus of claim 1, wherein said pin retention means comprises a cotter pin receivable within an aperture defined in a distal end of said pin.

8. The apparatus of claim 1, wherein said leg fastening means comprises a nut and bolt secured through an aperture in said leg.

9. The apparatus of claim 1, wherein said first and said second elastic member fastening means each comprise an S-hook received within an aperture in said first end and an aperture in said second end.

10. The apparatus of claim 1, further comprising a cap for fitting on to said upper end of said support member.

11. The apparatus of claim 1, wherein said at least one elastic member comprises a plurality of elastic members, each elastic member having a different modulus of elasticity so that when secured to said tab and said base the amount of resistive force is commensurate with the elasticity of each said elastic member.

* * * * *